US012655496B2

(12) United States Patent
Kim et al.

(10) Patent No.: US 12,655,496 B2
(45) Date of Patent: Jun. 16, 2026

(54) ULTRA-THICK STEEL SHEET WITH EXCELLENT STRENGTH AND LOW-TEMPERATURE IMPACT TOUGHNESS AND MANUFACTURING METHOD THEREOF

(71) Applicant: POSCO CO., LTD, Pohang-si (KR)

(72) Inventors: Woogyeom Kim, Pohang-si (KR); Sangho Kim, Pohang-si (KR); Daewoo Baek, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 77 days.

(21) Appl. No.: 18/268,808

(22) PCT Filed: Oct. 13, 2021

(86) PCT No.: PCT/KR2021/014121
§ 371 (c)(1),
(2) Date: Jun. 21, 2023

(87) PCT Pub. No.: WO2022/139135
PCT Pub. Date: Jun. 30, 2022

(65) Prior Publication Data

US 2024/0295001 A1 Sep. 5, 2024

(30) Foreign Application Priority Data

Dec. 21, 2020 (KR) ..... 10-2020-0179359

(51) Int. Cl.
*C22C 38/02* (2006.01)
*C21D 1/28* (2006.01)
(Continued)

(52) U.S. Cl.
CPC ..... *C21D 9/46* (2013.01); *C21D 1/28* (2013.01); *C21D 1/84* (2013.01); *C21D 6/004* (2013.01);
(Continued)

(58) Field of Classification Search
CPC ..... C22C 38/001; C22C 38/02; C22C 38/04; C22C 38/06; C22C 38/26; C22C 38/28;
(Continued)

(56) References Cited

U.S. PATENT DOCUMENTS

2018/0127857 A1 5/2018 Sun
2020/0017931 A1 1/2020 Kang et al.

FOREIGN PATENT DOCUMENTS

CN 101270437 A 9/2008
CN 105839003 A 8/2016
(Continued)

OTHER PUBLICATIONS

English translation of KR20160075925A obtained from EPO espacenet Aug. 16, 2025 (Year: 2025).*
(Continued)

*Primary Examiner* — Adam Krupicka
(74) *Attorney, Agent, or Firm* — Sughrue Mion, PLLC

(57) ABSTRACT

Disclosed are an ultra-thick steel sheet may have excellent strength and impact toughness, and a manufacturing method thereof. The ultra-thick steel sheet comprises, in percent by weight (wt %), 0.06 to 0.1% of C, 0.3 to 0.5% of Si, 1.35 to 1.65% of Mn, 0.015 to 0.04% of Al, 0.015 to 0.04% of Nb, 0.15 to 0.4% of Cr, 0.005 to 0.02% of Ti, 0.3 to 0.5% of Ni, 0.002 to 0.008% of N, 0.01% or less of P, 0.003% or less of S, and the remainder being Fe and inevitable impurities, and a microstructure, by area fraction, comprises 80% or more of polygonal ferrite with an average grain size of 40 μm or less and the remainder of pearlite with an average grain size of 20 μm or less.

3 Claims, 1 Drawing Sheet

(51) Int. Cl.

| | |
|---|---|
| ***C21D 1/84*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/48*** | (2006.01) |
| ***C22C 38/50*** | (2006.01) |
| ***C22C 38/58*** | (2006.01) |

(52) U.S. Cl.

CPC ..... *C21D 6/005* (2013.01); *C21D 6/008* (2013.01); *C21D 8/02* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/48* (2013.01); *C22C 38/50* (2013.01); *C22C 38/58* (2013.01); *C21D 2211/005* (2013.01)

(58) Field of Classification Search

CPC ..... C22C 38/38; C22C 38/40; C22C 38/50; C22C 38/58

See application file for complete search history.

(56) References Cited

FOREIGN PATENT DOCUMENTS

| | | | |
|---|---|---|---|
| CN | 108368594 | A | 8/2018 |
| CN | 111455255 | A | 7/2020 |
| CN | 112048664 | A | 12/2020 |
| EP | 3 719 162 | A1 | 10/2020 |
| JP | 6-200351 | A | 7/1994 |
| JP | 8-060239 | A | 3/1996 |
| JP | 11-256267 | A | 9/1999 |
| JP | 2004-232091 | A | 8/2004 |
| JP | 2011-195883 | A | 10/2011 |
| JP | 2012-172258 | A | 9/2012 |
| JP | 2020-509189 | A | 3/2020 |
| KR | 10-2012-0074638 | A | 7/2012 |
| KR | 10-2013-0120346 | A | 11/2013 |
| KR | 10-2016-0075925 | A | 6/2016 |
| KR | 10-2018-0073074 | A | 7/2018 |
| KR | 10-2018-0073075 | A | 7/2018 |
| WO | 2019/107700 | A1 | 6/2019 |

OTHER PUBLICATIONS

Communication dated Apr. 1, 2025 issued by the Japanese Patent Office in application No. 2023-538156.

International Search Report for PCT/KR2021/014121 dated, Apr. 22, 2022 (PCT/ISA/210).

Written Opinion of the International Search Authority for PCT/KR2021/014121 dated, Apr. 22, 2022 (PCT/ISA/237).

Korean Notice of Allowance for 10-2020-0179359 dated, Jan. 18, 2023.

Communication ("Notice of Reasons for Refusal") dated Oct. 1, 2024 for Japanese Patent Application No. 2023-538156.

Extended European Search Report dated Jul. 8, 2025 in Application No. 21911204.2.

Communication dated Feb. 13, 2026, issued in Chinese Application No. 202180090545.4.

* cited by examiner

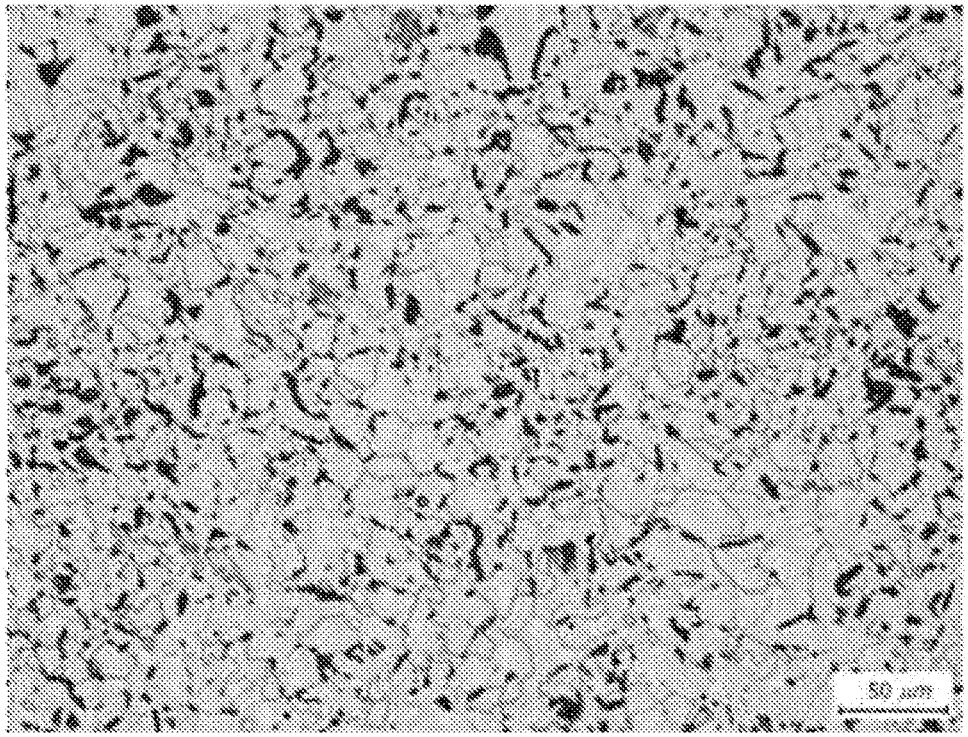
50 μm

ULTRA-THICK STEEL SHEET WITH EXCELLENT STRENGTH AND LOW-TEMPERATURE IMPACT TOUGHNESS AND MANUFACTURING METHOD THEREOF

CROSS REFERENCE TO RELATED APPLICATIONS

This application is a National Stage of International Application No. PCT/KR2021/014121 filed Oct. 13, 2021, claiming priority based on Korean Patent Application No. 10-2020-0179359 filed Dec. 21, 2020, the entire disclosures of which are incorporated herein by reference.

This application is based on and claims the benefit of priority to Korean Patent Application No. 10-2020-0179359, filed on Dec. 21, 2020 in the Korean Intellectual Property Office, the disclosure of which is incorporated herein by reference in its entirety.

TECHNICAL FIELD

The disclosure relates to an ultra-thick steel sheet with excellent strength and low-temperature impact toughness and a manufacturing method thereof, and more specifically, to an ultra-thick steel sheet with excellent strength and low-temperature impact toughness that may be applied to various industries such as frames of ships and offshore structures, materials for infrastructure industries such as bridges and constructions, and materials for wind power substructures, and a manufacturing method thereof.

BACKGROUND ART

Recently, in most of the infrastructure industries, energy industries, and the like, structures are becoming larger and gradually moving to cold regions and polar regions due to deterioration of installation environments and minimization of installation costs.

In line with such changes, the demand for ultra-thick steel with a thickness of 100 mm or more is expected to increase among structural steels applied to all industrial fields, and stable low-temperature impact toughness is required.

However, the metallurgical disadvantage of ultra-thick steel is that high strength is not easily achieved due to a decrease in rolling reduction, limitation of cooling, and the like. When an excessive amount of alloying elements is added to achieve strength, not only cost increases but also toughness rapidly deteriorates. Low-temperature rolling to compensate for inferior toughness is limited by product specifications, and removing alloying elements that adversely affect toughness causes a decrease in strength.

Methods for manufacturing ultra-thick steel sheets comprise a general rolling method, a thermo mechanical controlled process (TMCP) rolling method, a method of heat treatment and quenching after rolling, and a normalizing method of heat treatment and air cooling after rolling.

The general rolling method is a rolling method that does not control a rolling temperature, and is mainly applied to general steels that do not require impact toughness. Therefore, the general rolling method has limitations in applying to steels requiring low-temperature impact toughness.

In the TMCP rolling method, recrystallization rolling and non-recrystallization rolling are performed through temperature control, and cooling is performed as required to secure strength and impact toughness. However, when manufacturing an ultra-thick steel sheet, long waiting times to adjust rolling temperatures cause a serious loss of productivity.

In the method of heat treatment and quenching after rolling, high carbon components of 0.12C or higher are used, resulting in severe deterioration of toughness and cost due to heat treatment.

In the normalizing method of heat treatment and air cooling after rolling, grain refinement is ensured by reheating after normalizing with a relatively high C content, but impact toughness may be reduced due to the formation of a large amount of pearlite.

For ultra-thick steel sheets with a thickness of 100 mm or more, development of an ultra-thick material capable of overcoming the above disadvantages and ensuring both excellent strength and low-temperature toughness is required.

Technical Problem

An aspect of the present disclosure provides an ultra-thick steel sheet with excellent strength and low-temperature impact toughness by applying a normalizing method that performs heat treatment and air cooling after rolling.

Technical Solution

According to an embodiment of the present disclosure, an ultra-thick steel sheet with excellent strength and low-temperature impact toughness may comprise, in percent by weight (wt %), 0.06 to 0.1% of C, 0.3 to 0.5% of Si, 1.35 to 1.65% of Mn, 0.015 to 0.04% of Al, 0.015 to 0.04% of Nb, 0.15 to 0.4% of Cr, 0.005 to 0.02% of Ti, 0.3 to 0.5% of Ni, 0.002 to 0.008% of N, 0.01% or less of P, 0.003% or less of S, and the remainder being Fe and inevitable impurities. A microstructure, by area fraction, may comprise 80% or more of polygonal ferrite with an average grain size of 40 μm or less and the remainder of pearlite with an average grain size of 20 μm or less.

According to an embodiment of the present disclosure, a value of Formula (1) below may be 3.6 or more:

$$[Mn] + 5([Ni] + [Cr]) \quad (1)$$

wherein [Mn], [Ni], and [Cr] represent weight percentage (wt %) of the respective elements.

According to an embodiment of the present disclosure, the ultra-thick steel sheet may have a total thickness t of 100 to 200 mm, a yield strength of 320 MPa or more at ¼t from an outermost surface, and an impact toughness energy value of 200 J or more at −60 to −40° C.

According to an embodiment of the present disclosure, a manufacturing method of an ultra-thick steel sheet may comprise: reheating a slab comprising, in percent by weight (wt %), 0.06 to 0.1% of C, 0.3 to 0.5% of Si, 1.35 to 1.65% of Mn, 0.015 to 0.04% of Al, 0.015 to 0.04% of Nb, 0.15 to 0.4% of Cr, 0.005 to 0.02% of Ti, 0.3 to 0.5% of Ni, 0.002 to 0.008% of N, 0.01% or less of P, 0.003% or less of S, and the remainder being Fe and inevitable impurities; hot rolling comprising rough rolling the reheated slab at a rolling reduction of 70 to 120 mm so that a residual rolling reduction is 25 to 35%, and then finishing rolling; performing a normalizing heat treatment; and air cooling. The ultra-thick steel sheet may have a total thickness t of 100 to 200 mm.

According to an embodiment of the present disclosure, the finishing rolling may be performed at a rolling reduction of 70 to 110 mm.

According to an embodiment of the present disclosure, the rough rolling may be performed at over 1000° C.

According to an embodiment of the present disclosure, the finishing rolling may be performed at a temperature of 850 to A3° C.

According to an embodiment of the present disclosure, a finishing temperature of the hot rolling may be 820 to 910° C.

Advantageous Effects

The present disclosure provides an ultra-thick steel sheet having a thickness of 100 to 200 mm and excellent strength and impact toughness by controlling an alloy composition based on low carbon components and controlling manufacturing conditions such as a reduction ratio, and the like, and a manufacturing method thereof.

DESCRIPTION OF THE DRAWINGS

These and/or other aspects of the present disclosure will become apparent and more readily appreciated from the following description of the embodiments, taken in conjunction with the accompanying drawings of which:

The FIGURE is a microstructure photograph of an ultra-thick steel sheet according to an embodiment.

BEST MODE

An ultra-thick steel sheet according to an embodiment of the present disclosure comprises, in percent by weight (wt %), 0.06 to 0.1% of C, 0.3 to 0.5% of Si, 1.35 to 1.65% of Mn, 0.015 to 0.04% of Al, 0.015 to 0.04% of Nb, 0.15 to 0.4% of Cr, 0.005 to 0.02% of Ti, 0.3 to 0.5% of Ni, 0.002 to 0.008% of N, 0.01% or less of P, 0.003% or less of S, and the remainder being Fe and inevitable impurities, and a microstructure, by area fraction, comprises 80% or more of polygonal ferrite with an average grain size of 40 μm or less and the remainder of pearlite with an average grain size of 20 μm or less.

MODES OF THE INVENTION

Hereinafter, preferred embodiments of the present disclosure are now described. However, the present disclosure may be embodied in many different forms and should not be construed as limited to the embodiments described herein. Rather, these embodiments are provided so that the present disclosure will be thorough and complete and will fully convey the scope of the present disclosure to those skilled in the art.

The terms used herein are intended only to describe embodiments. Thus, a term used in the singular includes the plural unless the context clearly indicates a different meaning. Further, it is to be understood that terms such as "including" or "having" are intended to indicate the existence of features, steps, functions, components, or combinations thereof disclosed in the specification and are not intended to exclude the possibility that one or more other features, steps, functions, components, or combinations thereof may exist or be added.

Meanwhile, unless otherwise defined, all terms used herein have the same meanings as those commonly understood by one of ordinary skill in the art to which this disclosure belongs. Thus, these terms should not be interpreted in an idealized or overly formal sense unless expressly so defined herein. As used herein, the singular shall include the plural unless the context clearly indicates otherwise.

In addition, the terms "about", "approximately", "substantially", etc. used throughout the specification mean that when a natural manufacturing and substance allowable error is suggested, such allowable error corresponds to a value or is similar to the value, and such values are intended for the sake of clear understanding of the present disclosure or to prevent an unconscious infringer from illegally using the disclosure of the present disclosure.

In the specification, "average grain size" refers to the Equivalent Circular Diameter (ECD) of a grain.

Steels to which normalizing heat treatment is applied have a higher carbon content than steels to which thermo mechanical controlled process (TMCP), which is manufactured by controlled rolling and cooling to secure strength. Accordingly, steels to which normalizing heat treatment is applied tend to have inferior impact toughness even after heat treatment. In addition, when a heat treatment temperature is excessively high or heat treatment is prolonged, a strength may be reduced compared to that of a rolled steel sheet before heat treatment due to grain growth.

According to the present disclosure, excellent strength and impact toughness may be achieved by controlling an alloy composition based on low carbon components and controlling rolling conditions.

An ultra-thick steel sheet according to an embodiment of the present disclosure may comprise, in percent by weight (wt %), 0.06 to 0.1% of C, 0.3 to 0.5% of Si, 1.35 to 1.65% of Mn, 0.015 to 0.04% of Al, 0.015 to 0.04% of Nb, 0.15 to 0.4% of Cr, 0.005 to 0.02% of Ti, 0.3 to 0.5% of Ni, 0.002 to 0.008% of N, 0.01% or less of P, 0.003% or less of S, and the remainder being Fe and inevitable impurities.

Hereinafter, reasons for numerical limitations on the composition of the ultra-thick steel sheet in the embodiment of the present disclosure will be described.

The content of carbon (C) is 0.06 to 0.1 wt %.

Carbon (C) is a solid-solution strengthening element, and improves tensile strength by forming carbides in combination with Nb, etc., in steel. Therefore, in the present disclosure, C may be added at 0.06 wt % or more. However, when the C content is excessive, the pearlite fraction is excessively formed, resulting in inferior impact and fatigue properties at low temperatures, and deteriorating impact properties as the dissolved C content increases. In consideration thereof, the upper limit of the C content in the present disclosure may be controlled to 0.1 wt %. More preferably, the C content may be 0.07 to 0.09 wt %.

The content of silicon (Si) is 0.3 to 0.5 wt %.

Si serves to deoxidize molten steel together with Al and improves yield strength and tensile strength. Therefore, Si may be added at 0.3 wt % or more in the present disclosure. However, when the Si content is excessive, the diffusion of C may be prevented to promote the formation of Martensitic Islands constituent, and thus impact properties and fatigue properties at low temperatures may be deteriorated. In consideration thereof, the upper limit of the Si content in the present disclosure may be controlled to 0.5 wt %.

The content of manganese (Mn) is 1.35 to 1.65 wt %.

Mn is a solid-solution strengthening element, and may be added at 1.35 wt % or more in the present disclosure. However, excessive Mn content may cause a decrease in toughness due to the formation of MnS inclusions and central segregation. Therefore, the upper limit of the Mn content in the present disclosure may be controlled to 1.65 wt %.

The content of aluminium (Al) is 0.015 to 0.04 wt %.

Al acts as a major deoxidizer in steel and may be added at 0.015 wt % or more to fix N. However, when the Al content is excessive, the low-temperature toughness may be lowered due to an increase in the fraction and size of $Al_2O_3$ inclusions, and may cause the formation of Martensitic Islands in the base material and weld heat-affected zone, resulting in a deterioration of impact and fatigue properties at low temperatures. In consideration thereof, the upper limit of the Al content in the present disclosure may be controlled to 0.04 wt %.

The content of Niobium (Nb) is 0.015 to 0.04 wt %.

Nb inhibits recrystallization during rolling or cooling by solid solution strengthening or precipitating carbides for structure refinement, and thus strength is increased. In order to secure strength, Nb may be added at 0.015 wt % or more in the present disclosure. However, when the Nb content is excessive, the formation of Martensitic Islands constituent is promoted due to C affinity, resulting in a deterioration of impact and fatigue properties at low temperatures. In consideration thereof, the upper limit of the Nb content in the present disclosure may be controlled to 0.04 wt %.

The content of chromium (Cr) is 0.15 to 0.4 wt %.

Cr is an element for improving strength by increasing hardenability of steel, and may be added at 0.15 wt % or more in the present disclosure. However, excessive Cr content not only reduces weldability, but also, as an expensive element, increases manufacturing costs. In consideration thereof, the upper limit of the Cr content in the present disclosure may be controlled to 0.4 wt %.

The content of titanium (Ti) is 0.005 to 0.02 wt %.

Ti combines with dissolved N, which may deteriorate impact properties and surface quality, to form TIN. Also, the formed TiN improves toughness by contributing to refinement by inhibiting coarsening of the structure. In consideration thereof, Ti may be added at 0.005 wt % or more in the present disclosure. However, excessive Ti content may cause destruction by coarsening of precipitates, and also Ti that does not combine with N may remain in the steel and form TiC deteriorating the toughness of base material and welded part. In consideration thereof, the upper limit of the Ti content in the present disclosure may be controlled to 0.02 wt %.

The content of nickel (Ni) is 0.3 to 0.5 wt %.

Ni is an element that may improve both strength and toughness, and may be added at 0.3 wt % or more in the present disclosure. However, excessive Ni content saturates strength and toughness improvements, and increases manufacturing costs. Therefore, the upper limit of the Ni content in the present disclosure may be controlled to 0.5 wt %.

The content of nitrogen (N) is 0.002 to 0.008 wt %.

N forms precipitates with Ti, Nb, Al, etc. to form a fine austenitic structure when reheated, and as a result, strength and toughness are improved. In consideration thereof, N may be added at 0.002 wt % or more in the present disclosure. However, when the N content is excessive, surface cracking may occur at high temperatures, and toughness may be reduced due to remaining dissolved N in the steel. Therefore, the upper limit of the N content in the present disclosure may be controlled to 0.008 wt %.

The content of phosphorus (P) is 0.01 wt % or less.

P is an element that is inevitably contained in a manufacturing process of steel, and causes grain boundary segregation and steel embrittlement. In consideration thereof, the upper limit of the P content in the present disclosure may preferably be controlled to 0.01 wt %.

The content of sulfur (S) is 0.003 wt % or less.

S is an element that is inevitably contained in the manufacturing process of steel, and combines with Mn to form MnS, resulting in a decrease in low-temperature toughness. In consideration thereof, the upper limit of the S content in the present disclosure may preferably be controlled to 0.003 wt %.

The remaining component of the present disclosure is iron (Fe). The ultra-thick steel sheet of the present disclosure may comprise other impurities that may be comprised in a typical industrial production process of steel. Since these impurities are known to those skilled in the art to which the present disclosure belongs, the details thereof are not specifically described in the present disclosure.

According to an exemplary embodiment of the present disclosure, the ultra-thick steel sheet may satisfy the above-described alloy composition and have a value of 3.6 or more of Formula (1) below.

$$[Mn] + 5([Ni] + [Cr]) \quad (1)$$

In Formula 1 above, [Mn], [Ni], and [Cr] represent weight percentage (wt %) of the respective elements.

The value of Formula (1) is preferably 3.6 or more, to satisfy a desired strength and impact toughness of an ultra-thick steel sheet having a thickness of 100 to 200 mm, wherein the C content is 0.1 wt % or less.

A microstructure of the ultra-thick steel sheet according to an embodiment of the present disclosure may comprise 80% or more of polygonal ferrite and the remainder of pearlite by area fraction. More preferably, by area fraction, the microstructure of the ultra-thick steel sheet may comprise 80 to 90% of polygonal ferrite (excluding 80), and 10 to 20% of pearlite (excluding 20).

It is advantageous to have a fine microstructure to secure strength. According to an embodiment, an average grain size of polygonal ferrite may be 40 μm or less, and an average grain size of pearlite may be 20 μm or less.

The FIGURE is a microstructure photograph of an ultra-thick steel sheet according to an embodiment of the present disclosure. Referring to the FIGURE, it may be confirmed that polygonal ferrite having an average grain size of 40 μm or less is distributed in an area fraction of 80 to 90%, and pearlite having an average grain size of 20 μm is distributed in an area fraction of 10 to 20%. Referring to the FIGURE, it may be confirmed that the pearlite becomes spherical by C diffusion and formed at the grain boundary and inside the grain.

The ultra-thick steel sheet according to the present disclosure has excellent yield strength and low-temperature impact toughness. The ultra-thick steel sheet according to an embodiment may have a total thickness t of 100 to 200 mm, a yield strength of 320 MPa or more at ¼t from the outermost surface, and an impact toughness energy value of 200 J or more at −60 to −40° C.

Hereinafter, a manufacturing method of an ultra-thick steel sheet according to the present disclosure is described in detail.

The manufacturing method of ultra-thick steel sheet according to an embodiment of the present disclosure may comprise reheating a slab satisfying the above-described alloy composition, hot rolling, normalizing heat treatment and air cooling.

First, the slab satisfying the above-described alloy composition may be reheated at 1020 to 1150° C. When the reheating temperature is less than 1020° C., Ti, Nb, and the like, may not be sufficiently dissolved, resulting in a deterioration in strength. On the contrary, when the reheating temperature exceeds 1150° C., austenite crystal grains are coarsened, causing a decrease in toughness.

In hot rolling, rough rolling is performed before finishing rolling. The rough rolling is performed at a recrystallization temperature of 1000° C. or higher, and the finishing rolling is performed at a non-recrystallization temperature of 850 to A3° C. Rolling is advantageously performed at a temperature close to A3° C. for grain refinement, but may be performed at 850° C. or higher in consideration of productivity. Although the A3° C. temperature varies for each type of steel, the A3° C. temperature may be approximately 910° C. A finishing temperature of hot rolling is preferably 820 to 910° C.

In addition, the present disclosure relates to the ultra-thick steel sheet having a total thickness of 100 to 200 mm, and distribution of passes between the rough rolling and the finishing rolling is critical due to an insignificant total rolling reduction of approximately 200 mm in hot rolling. According to an embodiment of the present disclosure, the rough rolling may be performed at a rolling reduction of 70 to 120 mm so that a residual rolling reduction is 25 to 35%. Here, the residual rolling reduction is a percentage of finishing rolling reduction that may be reduced to a final thickness of the product after rough rolling relative to the total rolling reduction. According to an embodiment, the finishing rolling may be performed at a rolling reduction of 70 to 110 mm. Through the above-described rolling process, the ultra-thick steel sheet according to the present disclosure has a thickness of 100 to 200 mm.

The hot-rolled steel sheet may be subjected to normalizing heat treatment. According to an embodiment, normalizing heat treatment may be performed by raising a temperature to 880 to 920° C., and then maintaining in the temperature range for 200 to 300 minutes. Afterwards, the normalized steel is air-cooled to be manufactured as a final product.

Hereinafter, the present disclosure will be described in greater detail through examples. However, it is necessary to note that the following examples are only intended to illustrate the present disclosure in more detail and are not intended to limit the scope of the present disclosure. This is because the scope of the present disclosure is determined by matters described in the claims and able to be reasonably inferred therefrom.

Examples

A slab was prepared by continuously casting molten steel having the alloy composition shown in Table 1 below. An ultra-thick steel sheet having a thickness of 100 to 200 mm was prepared by reheating-rough rolling-finishing rolling-normalizing heat treatment-air cooling the prepared slab under the manufacturing conditions shown in Table 2 below. A value of Formula (1) in Table 2 is obtained by substituting the alloy composition in Table 1. In Comparative Example 4 of Table 2, normalizing heat treatment was omitted, and air cooling was performed immediately after rolling to produce an ultra-thick steel sheet.

TABLE 1

| | Alloy composition (wt %) | | | | | | | | | | |
|---|---|---|---|---|---|---|---|---|---|---|---|
| | C | Si | Mn | P | S | Al | Cr | Ni | Ti | Nb | N |
| Inventive example 1 | 0.078 | 0.45 | 1.55 | 0.01 | <0.002 | 0.025 | 0.253 | 0.374 | 0.012 | 0.03 | 0.0032 |
| Inventive example 2 | 0.081 | 0.38 | 1.54 | 0.01 | <0.002 | 0.027 | 0.262 | 0.388 | 0.012 | 0.025 | 0.004 |
| Inventive example 3 | 0.083 | 0.41 | 1.57 | 0.02 | <0.002 | 0.026 | 0.251 | 0.402 | 0.013 | 0.027 | 0.0035 |
| Comparative example 1 | 0.154 | 0.43 | 1.52 | 0.01 | <0.002 | 0.021 | 0.253 | 0.398 | 0.012 | 0.026 | 0.0042 |
| Comparative example 2 | 0.082 | 0.39 | 1.43 | 0.02 | <0.002 | 0.025 | 0.135 | 0.244 | 0.013 | 0.025 | 0.0038 |
| Comparative example 3 | 0.082 | 0.40 | 1.55 | 0.01 | <0.002 | 0.028 | 0.275 | 0.398 | 0.012 | 0.029 | 0.0033 |
| Comparative example 4 | 0.079 | 0.43 | 1.54 | 0.01 | <0.002 | 0.023 | 0.247 | 0.364 | 0.012 | 0.029 | 0.0034 |

TABLE 2

| | Reheating temperature (° C.) | Finishing rolling start temperature (° C.) | Finishing rolling end temperature (° C.) | Residual rolling reduction (%) | Normalizing temperature (° C.) | Formula (1) |
|---|---|---|---|---|---|---|
| Inventive example 1 | 1138 | 887 | 878 | 27 | 892 | 4.685 |
| Inventive example 2 | 1147 | 901 | 892 | 28 | 887 | 4.79 |
| Inventive example 3 | 1140 | 854 | 843 | 26 | 904 | 4.835 |
| Comparative example 1 | 1134 | 902 | 890 | 29 | 890 | 4.775 |

TABLE 2-continued

| | Reheating temperature (° C.) | Finishing rolling start temperature (° C.) | Finishing rolling end temperature (° C.) | Residual rolling reduction (%) | Normalizing temperature (° C.) | Formula (1) |
|---|---|---|---|---|---|---|
| Comparative example 2 | 1126 | 874 | 862 | 28 | 897 | 3.325 |
| Comparative example 3 | 1152 | 978 | 962 | 27 | 908 | 4.915 |
| Comparative example 4 | 1148 | 912 | 890 | 28 | Not experimented | 4.595 |

Table 3 shows the results of measuring a microstructure and physical properties of the prepared ultra-thick steel sheet.

In Table 3, 'impact (−40° C.)' and 'impact (−60° C.)' refer to impact toughness energy values at −40° C. and −60° C., respectively. The yield strength, tensile strength, and impact toughness energy values refer to physical property values at ¼t from the outermost surface, when t is a total thickness of the prepared steel sheet.

TABLE 3

| | Average ferrite grain size (μm) | Ferrite area fraction (%) | Average pearlite grain size (μm) | Pearlite area fraction (%) | Yield strength (MPa) | Tensile strength (MPa) | Elongation (%) | impact (−40° C.) (J) | impact (−60° C.) (J) |
|---|---|---|---|---|---|---|---|---|---|
| Inventive example 1 | 38 | 86 | 10 | 14 | 336 | 482 | 39 | 355 | 289 |
| Inventive example 2 | 35 | 87 | 12 | 13 | 349 | 472 | 38 | 334 | 288 |
| Inventive example 3 | 37 | 87 | 9 | 13 | 337 | 471 | 41 | 326 | 274 |
| Comparative example 1 | 48 | 69 | 20 | 31 | 375 | 495 | 22 | 56 | 21 |
| Comparative example 2 | 40 | 85 | 11 | 15 | 292 | 432 | 39 | 306 | 224 |
| Comparative example 3 | 67 | 78 | 23 | 22 | 311 | 445 | 40 | 74 | 23 |
| Comparative example 4 | 45 | 87 | 55 | 13 | 361 | 486 | 34 | 145 | 33 |

Referring to Table 1 to Table 3, when t is a total thickness of the prepared steel sheet, all the inventive examples satisfying the alloy composition and manufacturing conditions limited in the present disclosure have a yield strength of 320 MPa or more at ¼t from the outermost surface, and an impact toughness energy value of 200 J or more at −60 to −40° C. Therefore, it may be confirmed that the yield strength and low temperature impact toughness are excellent.

In Comparative Example 1, although the strength was increased due to the excessive pearlite formation caused by the excessive C content, the low-temperature impact toughness was sharply deteriorated.

In Comparative Example 2, the value of Formula (1) is less than 3.6, and strength was not sufficiently secured.

In Comparative Example 3, the alloy composition limited in the present disclosure was satisfied, but the finish rolling temperature was excessively high compared to the temperature range limited in the present disclosure. As a result, ferrite grains grew coarsely, resulting in a deterioration of strength and low-temperature impact toughness.

Comparative Example 4 satisfied the alloy composition and Formula (1) limited in the present disclosure. However, normalizing heat treatment was not performed, resulting in satisfactory strength but inferior low-temperature impact toughness.

Although embodiments have been described for illustrative purposes, those skilled in the art will appreciate that various modifications, additions and substitutions are possible, without departing from the scope and spirit of the present disclosure. Therefore, embodiments have not been described for limiting purposes.

INDUSTRIAL APPLICABILITY

According to the present disclosure, an ultra-thick steel sheet may have excellent strength and impact toughness by controlling an alloy composition based on low carbon components and controlling a manufacturing process such as a reduction ratio, and the like.

What is claimed is:

1. An ultra-thick steel sheet comprising, in percent by weight (wt %), 0.06 to 0.1% of C, 0.3 to 0.5% of Si, 1.35 to 1.65% of Mn, 0.015 to 0.04% of Al, 0.015 to 0.04% of Nb, 0.15 to 0.4% of Cr, 0.005 to 0.02% of Ti, 0.3 to 0.5% of Ni, 0.002 to 0.008% of N, 0.01% or less of P, 0.003% or less of S, and the remainder being Fe and inevitable impurities, wherein the ultra-thick steel sheet has a total thickness t of 100 to 200 mm, and wherein a microstructure, by area fraction, comprises 80% or more of polygonal ferrite with an average grain size of 40 μm or less and the remainder of pearlite with an average grain size of 20 μm or less.

2. The ultra-thick steel sheet of claim 1, wherein a value of Formula (1) below is 3.6 or more:

$$[Mn] + 5([Ni] + [Cr]) \quad (1)$$

(wherein [Mn], [Ni], and [Cr] represent weight percentage (wt %) of the respective elements).

3. The ultra-thick steel sheet of claim 1, wherein a yield strength of 320 MPa or more at ¼t from an outermost surface, and an impact toughness energy value of 200 J or more at −60 to −40° C.

* * * * *